US005743187A

United States Patent [19]

Toyoda et al.

[11] Patent Number: 5,743,187

[45] Date of Patent: Apr. 28, 1998

[54] PLATE CLAMPING DEVICE OF PRINTING PRESS

[75] Inventors: Hideaki Toyoda; Yutaka Endo, both of Higashikatsushika-gun, Japan

[73] Assignee: Komori Corporation, Tokyo, Japan

[21] Appl. No.: 725,986

[22] Filed: Oct. 4, 1996

[30] Foreign Application Priority Data

Oct. 4, 1995 [JP] Japan ..... 7-257349
Jan. 23, 1996 [JP] Japan ..... 8-008828

[51] Int. Cl.[6] ..... B41F 1/28

[52] U.S. Cl. ..... 101/415.1

[58] Field of Search ..... 101/415.1; 451/490

[56] References Cited

U.S. PATENT DOCUMENTS 3,557,695 1/1971 Pruess ..... 101/415.1
3,858,511 1/1975 Moyer ..... 101/415.1
4,133,264 1/1979 Fermi et al. ..... 101/415.1

FOREIGN PATENT DOCUMENTS 80 21716 4/1982 France ..... 101/415.1

*Primary Examiner*—Edgar S. Burr
*Assistant Examiner*—Dave A. Ghatt

[57] ABSTRACT

In a plate clamping device of a printing press for clamping a plate by a bottom clamping rail and a pressure plate, chips hardened to form serrations inclined in the lateral direction of a plate clamp so as to bite the plate in the direction of slipping-off of the plate are embedded in the clamp surfaces of the bottom clamping rail and the pressure plate such that the serrations on the bottom clamping rail side and the pressure plate side are inclined in opposite directions. Thus, the plate can be held with sufficient force without plastic deformation of the end of the plate, and the plate can be reused.

5 Claims, 9 Drawing Sheets

PLATE CLAMPING DEVICE OF PRINTING PRESS

BACKGROUND OF THE INVENTION

1. Field of the Invention

This invention relates to a plate clamping device of an intaglio printing press or a sheet-fed offset printing press.

2. Description of the Related Art

A plate cylinder of an intaglio printing press is equipped with a plate clamping device for pulling and locking the ends of a plate wound round the peripheral surface of the plate cylinder. A conventional plate clamping device is exemplified in FIG. 10. This plate clamping device comprises a combination of a bottom clamping rail 2 slidable in the peripheral direction of a plate cylinder 1; a pressure plate 5 for tightening and locking the end of a plate 3 onto the bottom clamping rail 2 by means of a set bolt 4; and a plate tension bolt 6 screwed into the bottom clamping rail 2. This combination at the leading edge of the plate 3 and the same combination at the trailing edge of the plate 3 are provided adjacently and symmetrically on a part of the peripheral surface of the plate cylinder 1. The respective plate tension bolts 6 are screwed into the bottom clamping rails 2 to slide the bottom clamping rails 2 in the direction of plate tension, thereby making the plate 3 spread tensely on the peripheral surface of the plate cylinder 1.

With a conventional plate clamping device, the clamp surfaces of the bottom clamping rail 2 and the pressure plate 5 are formed in the shape of big waves to cause wavy plastic deformation to the end of the plate 3 when clamping the plate 3.

Thus, the plate 3 that has been mounted is plastically deformed. When this plate 3 is dismounted and then mounted again, the positioning of the plate 3 while aligning the wavy form of the bottom clamping rail 2 and the pressure plate 5 with the wavy form of the plate 3 is very difficult. This is because tightening holes **3*b* for the set bolts 4 formed in the plate 3, and reference pin holes 3*a* of the plate 3 are each deformed in the shape of an elongated hole. Actually, the plate 3 cannot be positioned using reference pins, so that the reuse of the plate 3** and the use of reference pins are impossible.

A solution to this problem may be to make the wavy form of each of the bottom clamping rail 2 and the pressure plate 5 a small wavy form which will not cause the plastic deformation of the plate 3. This method may cause displacement or slipping-off of the plate pulled with a strong force during clamping.

SUMMARY OF THE INVENTION

It is an object of the present invention to provide a plate clamping device of a printing press which holds a plate with sufficient force without causing plastic deformation of the end of the plate and which permits reuse of the plate.

To attain this object, the present invention claims a plate clamping device of a printing press, adapted to clamp a plate by means of a bottom clamping rail and a pressure plate, wherein at least one of the clamp surfaces of the bottom clamping rail and the pressure plate is provided with a serrated portion biting in to the plate in a direction in which the plate slips off.

This configuration imparts sufficient clamping force without causing plastic deformation of the plate.

If the serrations are inclined, components of force parallel to the serrations are counteracted to obtain a stable clamp force in the lateral direction of the clamp.

If the serrations head in different directions at a plurality of sites in the lateral direction of the clamp, respective forces in the lateral direction of the clamp are balanced.

If the serrated portion is formed at the surface of the chip embedded in the clamp surface, its formation is easy and leads to reduced costs.

BRIEF DESCRIPTION OF THE DRAWINGS

The present invention will become more fully understood from the following detailed description in conjunction with the accompanying drawings which are given for the purpose of illustration only, and thus are not limitative, and wherein.

DETAILED DESCRIPTION OF THE PREFERRED EMBODIMENTS

Figure 10:
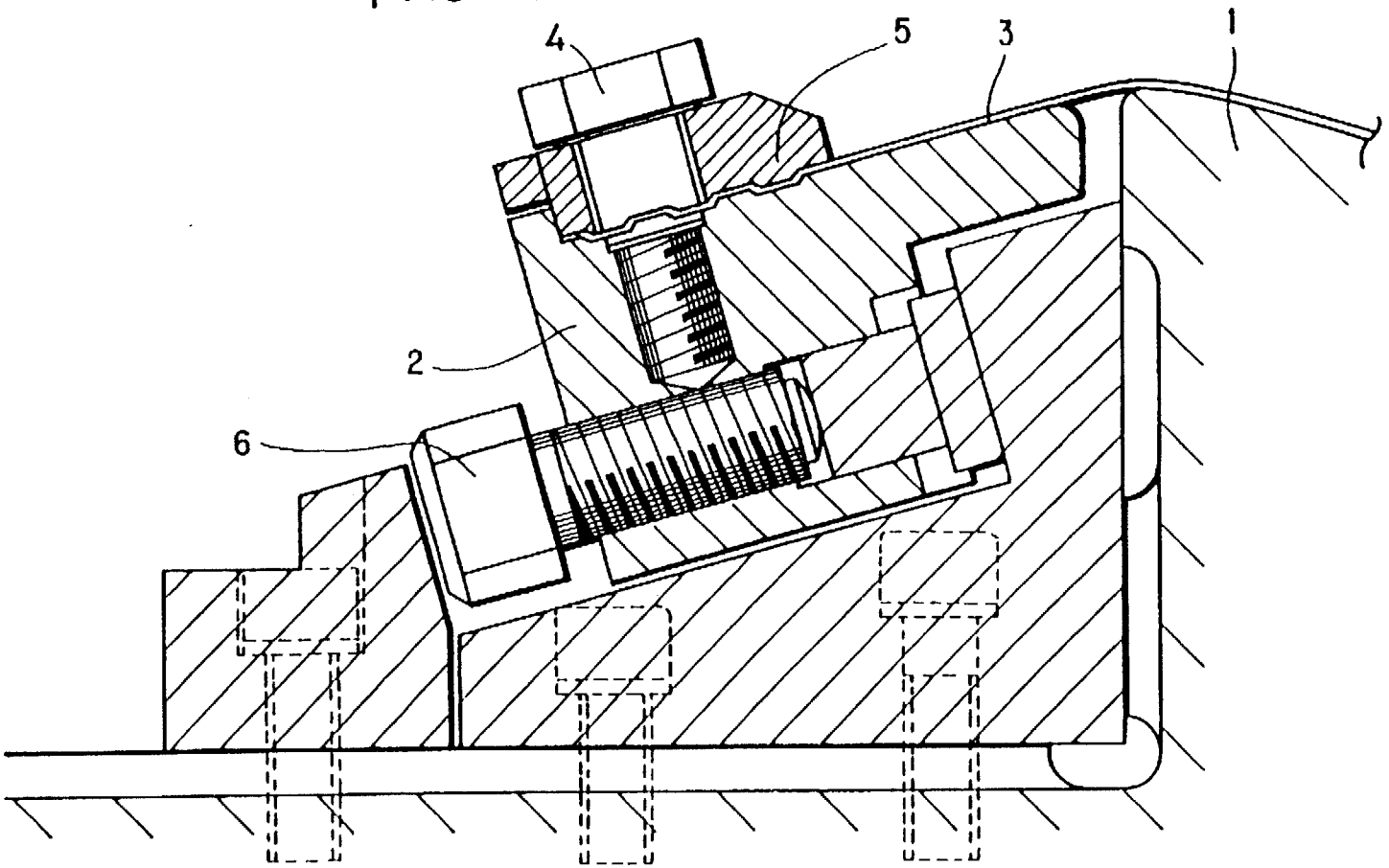
Fig. 10 prior art
FIG. 10 is a sectional view of an essential part of a conventional plate clamping device.

An embodiment of a plate clamping device of a printing press concerned with the present invention will be described by reference to FIG. 1 to FIG. 6, in which the same members as in FIG. 10 are assigned the same numerals, and overlapping explanations are omitted.

Figure 1:
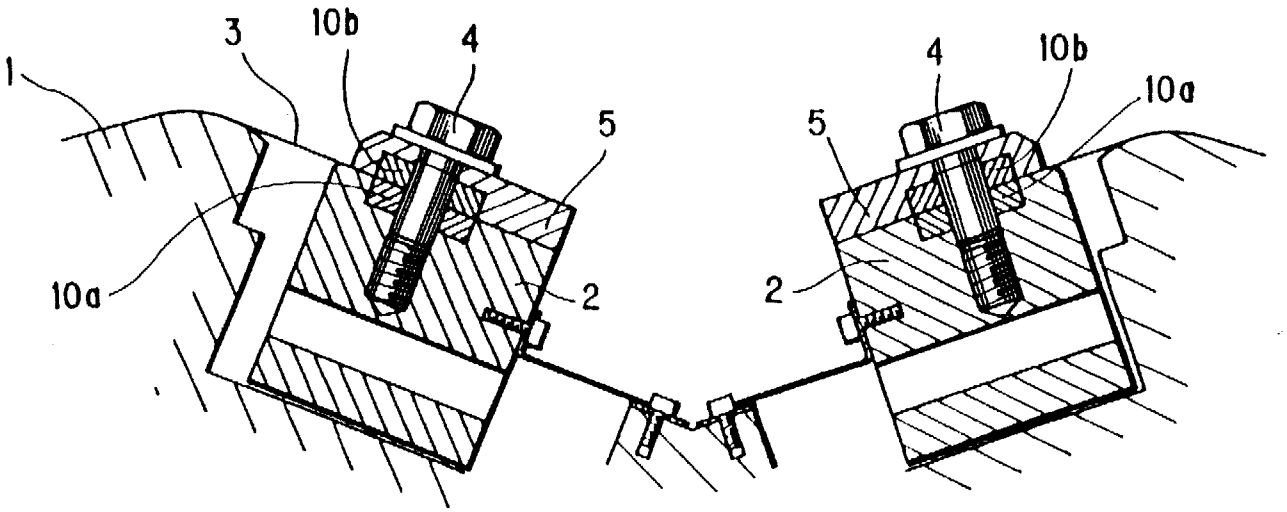
FIG. 1 is a sectional view of an essential part of a plate clamping device concerned with an embodiment of the present invention.
Figure 4:
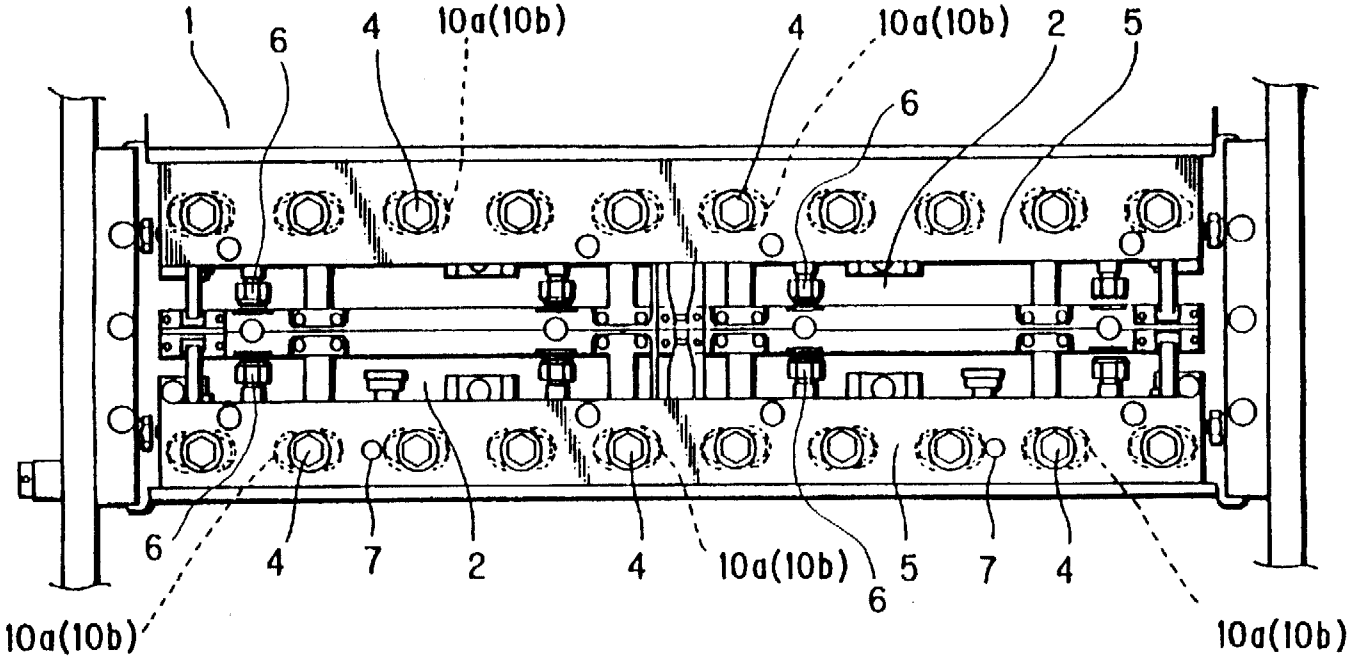
FIG. 4 is a plan view of the entire plate clamping device.

As shown in FIG. 1 and FIG. 4, a bottom clamping rail 2 slidable in the peripheral direction of a plate cylinder 1; a pressure plate 5 for tightening and locking the end of a plate 3 onto the bottom clamping rail 2 by means of a plurality of set bolts 4; and a plurality of plate tension bolts 6 screwed into the bottom clamping rail 2 form a combination. This combination at the leading edge of the plate 3 and the same combination at the trailing edge of the plate 3 are provided adjacently and symmetrically on a part of the peripheral surface of the plate cylinder 1.

A plurality of (ten in the drawings) chips **10*a*, 10*b* are embedded in flat clamp surfaces of the bottom clamping rail 2 and the pressure plate 5** with predetermined spacing in the lateral direction of the clamp.

Figure 2:
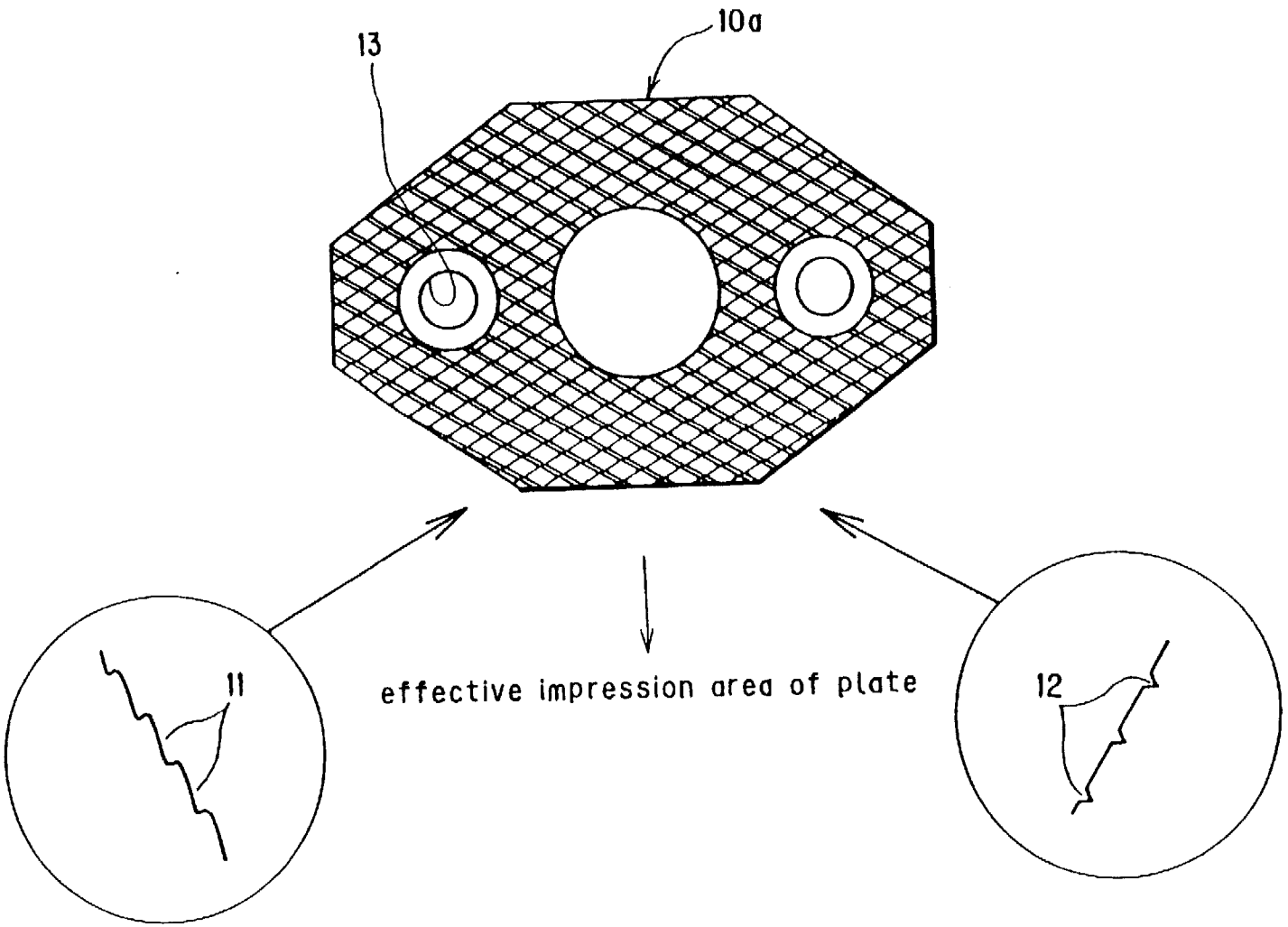
FIG. 2 is an explanatory view of a chip on the bottom clamping rail of the plate clamping device.

That surface of the chip **10*a* on the bottom clamping rail 2 side which contacts the plate 3 is processed by hardening to form serrations 11 0.2 to 0.3 mm deep and inclined at a predetermined angle (about 20° to 30°) with a pitch of 1 to 1.5 mm so as to engage the plate 3 in the direction of slipping-off of the plate 3 (see the direction of an effective impression area shown by an arrow), as illustrated in FIG. 2**.

Tooth spaces 12 are similarly formed with a pitch of 1 to 1.75 mm by hardening such that the tooth spaces 12 are 0.2 to 0.3 mm deep and inclined in a direction opposite to the direction of the serrations 11. The numeral 13 denotes a mounting hole for mounting by a bolt or the like.

Figure 3:
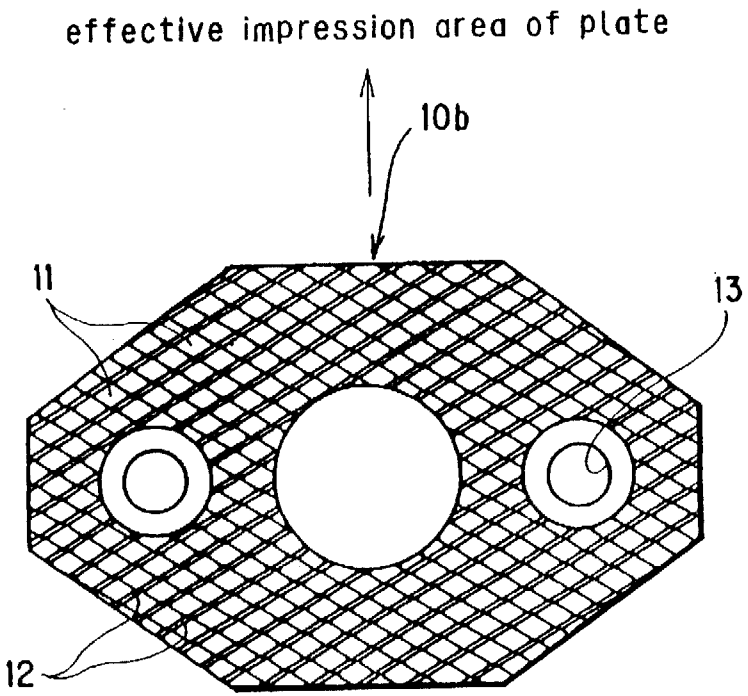
FIG. 3 is an explanatory view of a chip on the pressure plate of the plate clamping device.

The surface of the chip 10*b* on the pressure plate 5 side is also processed by hardening to form serrations 11 and tooth spaces 12 of the same design as for the chip 10*a* on the bottom clamping rail 2 side, as shown in FIG. 3. The chip 10*a* on the bottom clamping rail 2 side and the chip 10*b* on the pressure plate 5 side are mounted such that the serrations 11 and tooth spaces 12 of the chip 10*a* and those of the chip 10*b* intersect (are inclined in opposite directions).

Figure 5B:
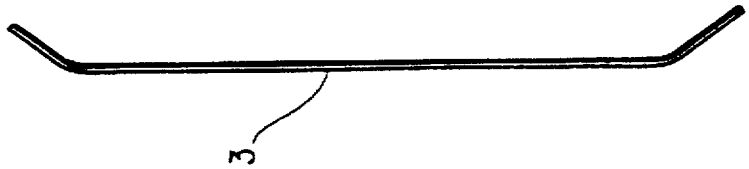
FIG. 5 (*a*) and 5 (*a*) are explanatory views of a plate on the plate clamping device.
Figure 5A:
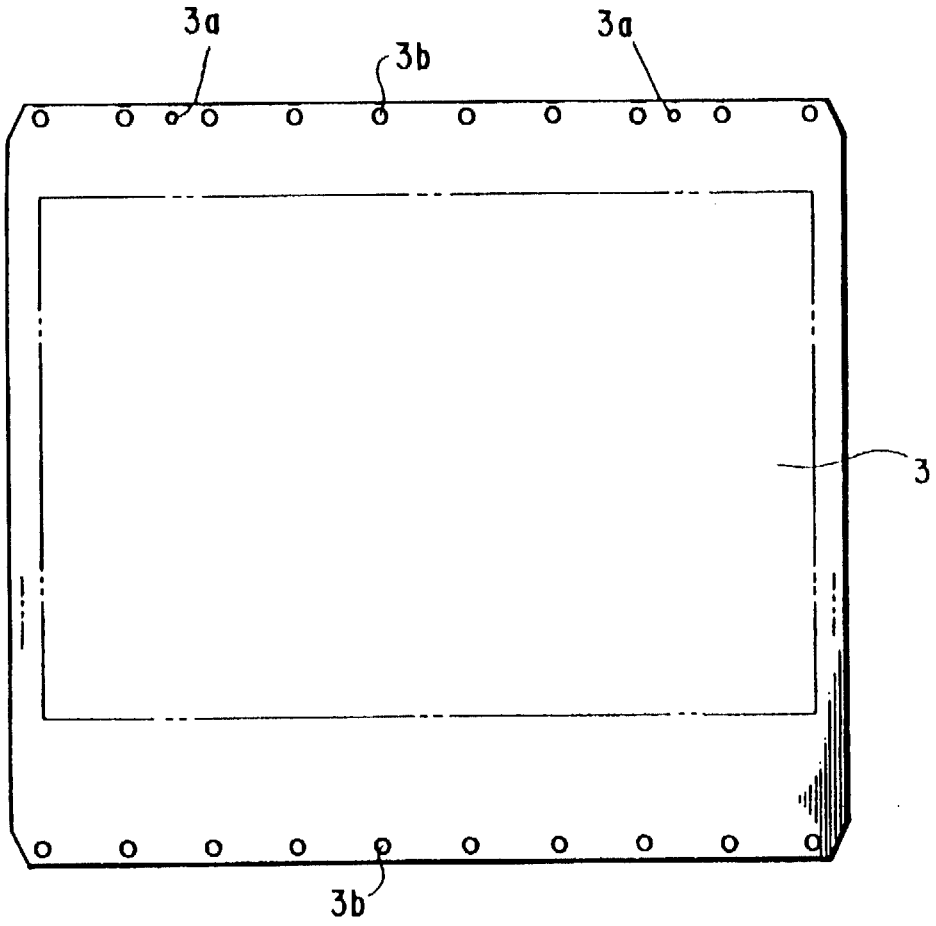

Because of this configuration, the plate 3 bent as shown in FIG. 5 by a plate bender has its leading edge positioned by fitting two reference pin holes 3*a*, formed at the leading edge, over two reference pins 7 (see FIG. 4) on the bottom clamping rail 2. Then, the pressure plate 5 is placed, and the leading edge of the plate 3 is clamped onto the bottom clamping rail 2 by means of the set bolts 4. Likewise, the trailing edge of the plate 3 is clamped, and tension is applied by the plate tension bolts 6, whereby the plate 3 is intimately contacted with the surface of the plate cylinder 1.

At this time, the serrations 11 of the above-mentioned chips 10*a*, 10*b* enable a low clamping force to impart a sufficient tension which will bring the plate 3 into intimate contact with the surface of the plate cylinder 1 without the plate 3 slipping.

The inclination of the serrations 11 increases the area of engagement with the plate 3 to give a sufficient force for holding the plate 3. Moreover, the serrations 11 of the chips 10*a* and 10*b* intersect each other. Thus, components of force parallel to the serrations 11 during pulling of the plate are counteracted, so that the plate 3 does not move in the right-and-left direction (in the lateral direction of the clamp). Hence, a stable pulling force can be generated.

The tooth spaces 12 are effective in uniformizing the contact of the plate 3 during clamping, and facilitating the removal of the plate during opening. However, the tooth spaces 12 may be omitted.

With a conventional plate clamping device, the end of the plate 3 was plastically deformed in wavy form by a clamping force of the set bolt 4 to secure a plate holding force. In this case, since the plate 3 remounted was sure to move during clamping, the reference pins 7 as used in the instant embodiment were not usable. Thus, the positioning of the plate 3 was very difficult, and plate alignment with a triple- or quadruple-sized plate, in particular, took time, resulting in low productivity. In the instant embodiment, by contrast, the plate 3 is not plastically deformed, and the plate 3 dose not move during clamping. Thus, the reference pins 7 are used to position the plate 3 promptly and easily, increasing productivity.

With a conventional plate clamping device, furthermore, the end of the plate 3 is plastically deformed in wavy form. Thus, the tightening holes 3*b* are deformed in the shape of elongated holes, and bite into the set bolts 4, making plate removal difficult, and posing difficulty in plate mounting for reuse of the plate. In the instant embodiment, on the other hand, the tightening holes 3*b* are free from deformation, markedly facilitating the removal of the plate 3 and the mounting of the plate 3 for its reuse.

Figure 6A:
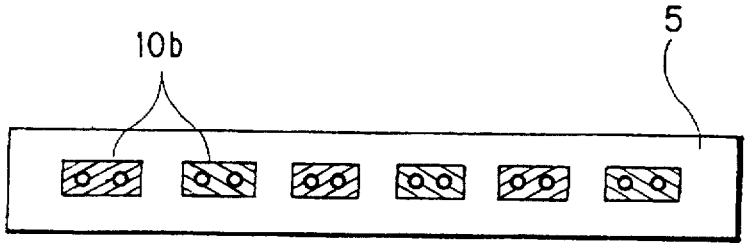
FIG. 6 (*a*) and 6 (*a*) are explanatory views showing an example of the arrangement of the chips.
Figure 6B:
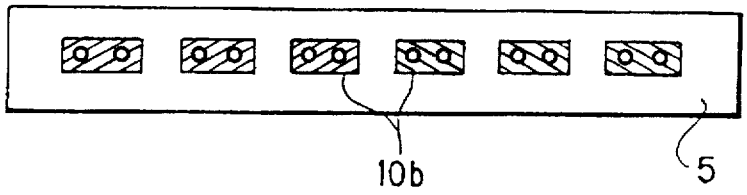

In the foregoing embodiment, the serrations 11 and the tooth spaces 12 are formed in the chips 10a, 10b, but may be directly formed in the bottom clamping rail 2 and the pressure plate 5. Alternatively, as shown in FIG. 6, the chips 10*b*(and 10*a*) of the pressure plate 5 (and the bottom clamping rail 2) may be arranged such that their serrations 11 are inclined either alternately differently (FIG. 6(*a*)), or symmetrically with respect to the center (FIG. 6(*b*)), to keep a balance of force in the right-and-left direction (in the lateral direction of the clamp).

Figure 7A:
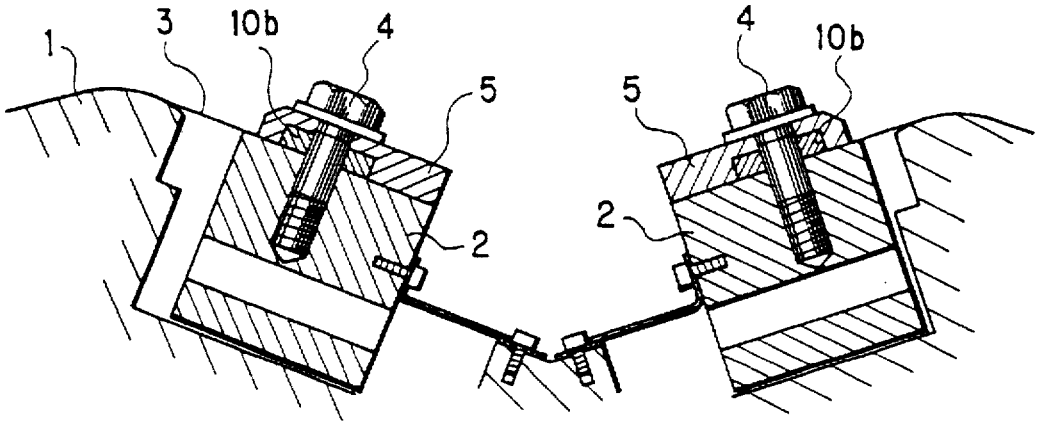
FIG. 7 (*a*) and 7 (*a*) is a sectional view of an essential part showing another embodiment of the present invention, (a) showing chips provided only on the pressure plate side, and (b) showing chips provided only on the bottom clamping rail side.
Figure 7B:
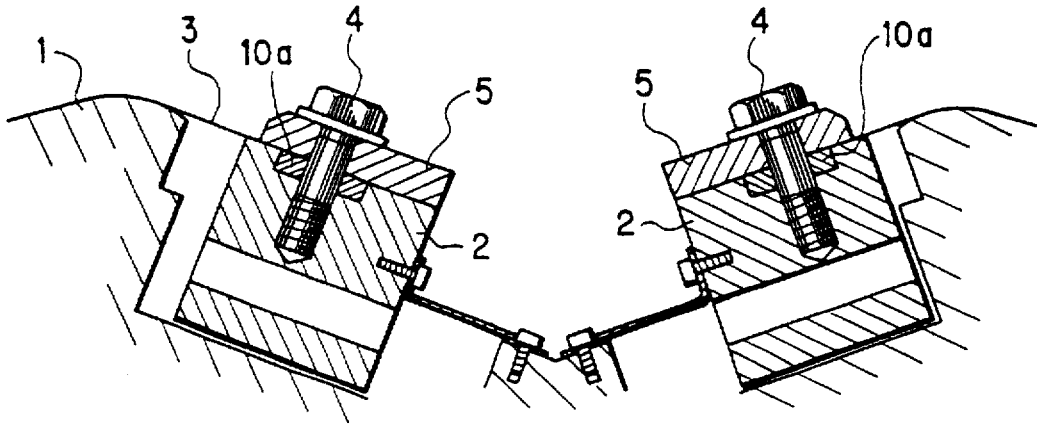

In this case, the chips 10*b* (10*a*) are balanced in terms of force in the right-and-left direction (in the lateral direction of the clamp). Thus, there is no need to provide the chips 10*b* (10*a*) in both of the bottom clamping rail 2 and the pressure plate 5 as shown in the aforementioned embodiment. As illustrated in FIG. 7, the chips 10*b* (10*a*) may be provided on the pressure plate 5 side only, and the bottom clamping rail 2 side may be formed in a flat shape [FIG. 7(*a*)]. Alternatively, the chips 10*a* (10*b*) may be provided on the bottom clamping rail 2 side only, and the pressure plate 5 side may be formed in a flat shape [FIG. 7(*b*) ]By so doing, a comparable holding force to the aforementioned embodiment can be obtained.

Figure 8:
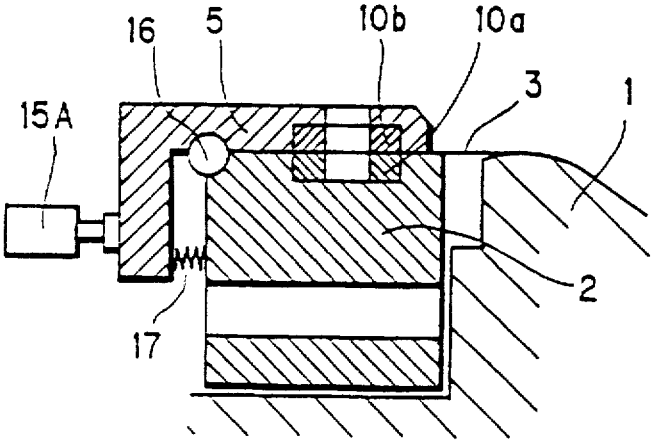
FIG. 8 is a sectional view of an essential part showing still another embodiment of the present invention.
Figure 9:
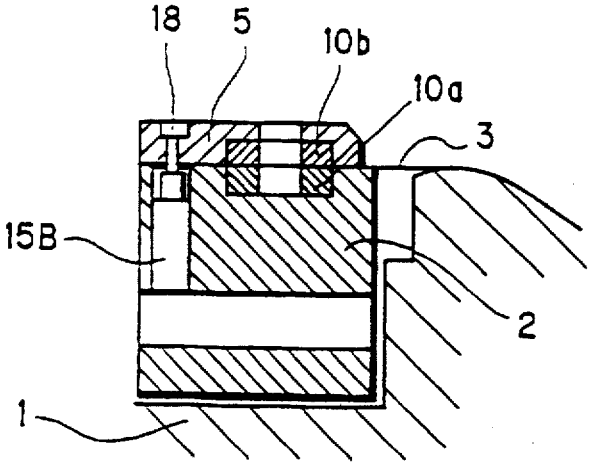
FIG. 9 is a sectional view of an essential part showing a further embodiment of the present invention.

The instant embodiment has been described using the set bolts 4 to clamp the plate 3. However, the present invention can be applied to an embodiment using an air cylinder 15A or 15B as shown in FIG. 8 and FIG. 9, or to an embodiment in which the pressure plate is opened and closed by a cam mechanism. In FIG. 8, when a plate 3 is to be inserted, the air cylinder 15A is extended to turn a pressure plate 5 about a support shaft 16. When the plate 3 is to be clamped, the air cylinder 15A is contracted to turn the pressure plate 5 in the clamping direction by the spring force of a compressed coiled spring 17. In FIG. 9, when the plate 3 is to be inserted, the air cylinder 15B is extended, whereupon a bolt 18 locked to the front end of a piston rod pushes a pressure plate 5 upward to allow the insertion of the plate 3. When the plate 3 is to be clamped, the air cylinder 15B is contracted, whereby the pressure plate 5 goes down to clamp the plate 3 onto a bottom clamping rail 2.

As described so far, according to the present invention, at least one of the clamp surfaces of the bottom clamping rail and the pressure plate is provided with a serrated portion biting in to the plate in a direction in which the plate slips off. Thus, the plate is held with sufficient force without causing plastic deformation to the end of the plate, so that printing quality and productivity are improved. Also, reuse of the plate is possible, and the efficiency of mounting and dismounting is increased. In addition, the plate does not slip off even when the clamping force is relatively low. Thus, small set bolts suffice, making the plate clamping device compact.

If the serrations are inclined, components of force parallel to the serrations are counteracted to obtain a stable clamp force in the lateral direction of the clamp.

If the serrations head in varying directions at a plurality of sites in the lateral direction of the clamp, respective forces in the lateral direction of the clamp are balanced.

If the serrated portion is formed at the surface of the chip embedded in the clamp surface, its formation is easy and leads to reduced costs.

While the present invention has been described in the foregoing fashion, it is to be understood that the invention is not limited thereby, but may be varied in many other ways.

Such variations are not to be regarded as a departure from the spirit and scope of the invention, and all such modifications as would be obvious to one skilled in the art are intended to be included within the scope of the following claims.

What is claimed is:

1. A plate clamping device of a printing press, for clamping a plate comprising:

a bottom clamping rail and a pressure plate each having a clamping surface parallel to each other and parallel to at least one end of the plate, wherein each clamping surface defines a lateral direction, at least one of the clamping surfaces is provided with a serrated portion including serrations biting in to said plate, said serrations being inclined with respect to the lateral direction, so that disengagement of the plate from the clamping device is prevented, wherein the at least one clamping surface includes a plurality of locations containing the serrations, and the serrations in the plurality of the locations face in different directions.

2. A plate clamping device of a printing press, for clamping a plate comprising:

a bottom clamping rail and a pressure plate each having a clamping surface parallel to each other and parallel to at least one end of the plate, wherein each clamping surface defines a lateral direction, at least one of the clamping surfaces is provided with a serrated portion including serrations biting in to said plate, said serrations being inclined with respect to the lateral direction, so that disengagement of the plate from the clamping device is prevented, and wherein a chip is embedded in the at least one clamping surface, the chip having a chip clamping surface facing said plate and said serrations are in the chip clamping surface.

3. The plate clamping device of claim 2, further including at least one chip embedded in both said clamping surface of the bottom clamping rail and the pressure plate, the embedded chips having a first surface facing the plate, and the embedded chips each containing serrations for biting in to the plate.

4. The plate clamping device of claim 3, wherein there are a plurality of chips embedded in the bottom clamping rail, and a plurality of chips are embedded in the pressure plate.

5. A plate clamping device of a printing press, for clamping a plate comprising:

a bottom clamping rail and a pressure plate each having a clamping surface parallel to each other and parallel to at least one end of the plate, wherein each clamping surface defines a lateral direction, at least one of the clamping surfaces is provided with a serrated portion including serrations biting in to said plate, said serrations being inclined with respect to the lateral direction, so that disengagement of the plate from the clamping device is prevented, and said serrated portion is provided on both a surface of the bottom clamping rail and the surface of the pressure plate, the serrations on the bottom clamping rail face in a first direction, and the serrations on the pressure plate face in a second direction, said second direction being a different direction than said first direction.

* * * * *